US011230880B2

(12) United States Patent
Magro et al.

(10) Patent No.: US 11,230,880 B2
(45) Date of Patent: Jan. 25, 2022

(54) UNITARY EXTRUDED SHELL FOR ASSEMBLING NON-INSULATED AND INSULATED SLATS FOR ROLLING DOORS AND METHOD OF FORMING SAME

(71) Applicant: ALPINE OVERHEAD DOORS, INC., East Setauket, NY (US)

(72) Inventors: Sebastian Magro, Stony Brook, NY (US); Michael Magro, Stony Brook, NY (US)

(73) Assignee: ALPINE OVERHEAD DOORS, INC., East Setauket, NY (US)

( * ) Notice: Subject to any disclaimer, the term of this patent is extended or adjusted under 35 U.S.C. 154(b) by 198 days.

(21) Appl. No.: 15/944,444

(22) Filed: Apr. 3, 2018

(65) Prior Publication Data

US 2019/0301237 A1 Oct. 3, 2019

(51) Int. Cl.
*E06B 9/15* (2006.01)
*E06B 9/165* (2006.01)

(52) U.S. Cl.
CPC ..... *E06B 9/15* (2013.01); *E06B 9/165* (2013.01); *E06B 2009/1505* (2013.01); *E06B 2009/1522* (2013.01); *E06B 2009/1538* (2013.01); *E06B 2009/1544* (2013.01)

(58) Field of Classification Search
CPC ..... E06B 9/15; E06B 2009/1505; E06B 2009/1544; E06B 2009/1522; E06B 2009/1538; E06B 9/165
See application file for complete search history.

(56) References Cited

U.S. PATENT DOCUMENTS 880,701 A * 3/1908 Vance ..... E06B 3/485 160/232
897,990 A * 9/1908 McCloud ..... E06B 9/15 160/235
1,352,656 A * 9/1920 Cahill ..... E06B 9/15 160/232
1,910,047 A * 5/1933 Passoni ..... E06B 9/15 160/220
3,732,913 A * 5/1973 Wrono ..... E06B 9/15 160/133
4,183,393 A * 1/1980 Bailey ..... E06B 3/70 160/232

(Continued)

*Primary Examiner* — Catherine A Kelly
*Assistant Examiner* — Abe Massad
(74) *Attorney, Agent, or Firm* — Nolte Lackenbach Siegel; Myron Greenspan

(57) ABSTRACT

An elongate shell for forming a slat for a rolling door includes a planar portion having parallel first and second longitudinal edges and formed along the first longitudinal edge with a first arcuate segment and formed along an opposing second longitudinal edge with second arcuate segment, the first and second arcuate segments being positioned on the same side of said planar portion and configured and dimensioned to enable the second arcuate segment of a first shell to be received with clearance within a first arcuate segment of second shell identical to the first shell to form an articulated joint hingedly connecting the elongate shells so they can be pivoted relative to each other. Two identical shells can be oriented to be assembled to form a double-walled slat with longitudinal hooks or claws for assembling a plurality of slats, with or without insulation, into a curtain assembly for a rolling door.

19 Claims, 10 Drawing Sheets

(56) References Cited

U.S. PATENT DOCUMENTS

| | | | | | |
|---|---|---|---|---|---|
| 4,436,136 | A | | 3/1984 | Downey | |
| 4,470,444 | A | * | 9/1984 | Riexinger | E06B 9/15 160/235 |
| 4,536,929 | A | * | 8/1985 | Riexinger sen. | E06B 9/15 264/46.5 |
| 4,601,953 | A | | 7/1986 | Haffer | |
| 4,628,982 | A | | 12/1986 | Labelle | |
| 4,972,894 | A | * | 11/1990 | Machill | E06B 9/15 160/235 |
| 4,979,553 | A | | 12/1990 | Lowry et al. | |
| 5,170,832 | A | * | 12/1992 | Wagner | E05D 15/24 160/201 |
| 5,419,386 | A | * | 5/1995 | Magro | E06B 9/15 160/232 |
| 5,622,012 | A | * | 4/1997 | Schijf | E05D 15/242 16/355 |
| 8,109,316 | B2 | * | 2/2012 | Wang | E06B 9/15 160/232 |
| 9,534,441 | B2 | * | 1/2017 | Allen | E05D 1/04 |
| 2016/0230444 | A1 | * | 8/2016 | Hahn | F41H 5/045 |
| 2017/0022753 | A1 | * | 1/2017 | Allen | E05D 1/04 |

* cited by examiner

UNITARY EXTRUDED SHELL FOR ASSEMBLING NON-INSULATED AND INSULATED SLATS FOR ROLLING DOORS AND METHOD OF FORMING SAME

BACKGROUND OF THE INVENTION

1. Field of the Invention

The present invention generally relates to unitary extruded shell using same for assembling non-insulated and insulated slats for rolling doors.

2. Description of the Prior Art

While numerous insulated overhead doors have been proposed most of these only provide insulation between front and rear panels or walls of each slat. In accordance with your proposed design, the curved engaging ends, which couple or link one slat to the next adjoining slat are covered with a heat insulating material so that there is no heat transfer through the engaging or coupling ends themselves.

Prior to proceeding with a patent application, we have conducted a preliminary novelty search to see if that concept has been disclosed or suggested. Attached as Appendix B are numerous patents that relate to the subject matter. Your attention is particularly directed to the patents discussed below:

In U.S. Pat. No. 4,628,982 issued on Dec. 16, 1986 to Labelle for an Insulated Closure Panel, the front and rear walls of each slat is made of different materials, the outer wall 3 being made of metal while the inner wall 5 is made of plastic which is a thermally insulated material. The space between these two walls is filled with insulation 13. Since the wall 5 is made of a thermally insulating plastic material the portions thereof that form part of the engaging or linking ends are also resistant to heat transfer since the coupling ends are formed of a metal portion in contact with a plastic portion so that heat cannot be transmitted through the ends of the panels. A similar design is disclosed in U.S. Pat. No. 4,979,553 issued on Dec. 25, 1990 to Lowry, et al. for a Slat Assembly and Curtain for Rolling Door where the outer shell or skin of each slat 18 is made of metal while the inner skin or wall 48 of each slat is made of a plastic such as PVC. In some of these designs, such as the one shown in FIG. 3 of this patent, the entire inner space is also filled with a heat insulating material.

Similarly, in U.S. Pat. No. 4,601,953 issued on Jul. 22, 1986 to Haffer for a Rolling Shutter Bar, each slat is shown composed of metal outer skin 5 while the bulk of the slat itself is made of an extruded plastic hollow member. This design would, likewise, resist the heat transfer not only through the central portion or core of the slat but the linking edges as well.

U.S. Pat. No. 4,972,894 issued on Nov. 27, 1990 to Machill discloses a Roller Curtain. Referring to FIG. 1 of this patent, for example, a plastic PVC wall or skin 14 is disclosed on the inside of each panel while the outside skin or wall 12 is formed of metal. The space or cavity between the wall is filled with an insulation 16. A further sealing edge 38 is provided for providing an air seal and preventing heat loss through any spaces or clearances between the interlocking edges.

A further design addressing the same problem is U.S. Pat. No. 4,436,136 issued on Mar. 13, 1984 to Downey for an Insulated Slat. An insulation cover piece 18 made of plastic such as PVC is used in this design as in some of the previous designs.

SUMMARY OF THE INVENTION

In order to overcome and improve the prior art designs, the object of the present invention to provide a unitary extruded shell that can be used to assemble single or double walled slats used in rolling doors.

It is another object of the invention to provide a shell as in the previous object which is simple in construction and economical to manufacture.

It is still another object of the invention to produce double walled slats for rolling doors from a single profile extrusion.

It is yet another object of the invention to provide single or double walled slat using shells of the type mentioned in the previous objects.

It is still a further object of the invention to provide a rolling door slat as in the previous objects that uses a unitary shell construction or extrusion that can be formed into insulated or non-insulated rolling door slats.

It is still another object of the invention to provide a rolling door slat of the type under discussion that is effective to insulate the inside from the outside walls of a rolling door slat without filling the space between the inside and outside shells with insulation.

It is yet another object to provide a slat construction from a unitary extruded shell, as in the previous objects, that can be easily modified to enhance its resistance to ballistics.

In order to achieve the above and other objects it will become evident from the description that follows an elongate shell for a rolling door, said elongate shell comprising a planar portion defining a plane and longitudinal and transverse directions within said plane and having opposing first and second surfaces facing in opposing first and second normal directions and having parallel first and second longitudinal edges extending along said longitudinal direction of said planar portion, said elongate shell being formed along said first longitudinal edge with a first arcuate segment open in a direction of said first normal direction and formed along an opposing second longitudinal edge with a second arcuate segment also open in a direction of said first normal direction, said first and second arcuate segments being positioned on the same side of said planar portion and offset from said second surface in said second normal direction and configured and dimensioned to enable said second arcuate segment of a first shell to be received with clearance within a first arcuate segment of a second shell substantially identical to said first shell to form an articulated hinge, whereby two hingedly joined elongate shells can be pivoted relative to each other from a generally co-planar orientation of planar portions of associated coupled or linked shells within said plane in directions to either side of said co-planar orientation.

According to the invention, a rolling door slat comprises A rolling door slat comprising first and second substantially identical elongate shells, each shell comprising a planar portion defining a plane and longitudinal and transverse directions within said plane and having opposing first and second surfaces facing in opposing first and second normal directions and having parallel first and second longitudinal edges extending along said longitudinal direction of said planar portion, said elongate shell being formed along said first longitudinal edge with a first arcuate segment open in a direction of said first normal direction and formed along an opposing second longitudinal edge with a second arcuate segment also open in a direction of said first normal direction, said first and second arcuate segments being positioned on the same side of said planar portion and offset from said second surface in said second normal direction and configured and dimensioned to enable said second arcuate segment of a first shell to be received with clearance within a first arcuate segment of a second shell substantially identical to said first shell to form an articulated hinge, whereby two hingedly joined elongate shells can be pivoted relative to each other from a generally co-planar orientation of planar portions of associated coupled or linked shells within said plane in directions to either side of said co-planar orientation, said first and second shells being displaced from each other by 180° within planes parallel to said planes of respective planar portions and being joined to each other by linking a first arcuate segment of said first shell with a second arcuate segment of said second shell and a second arcuate segment of said first shell with a first arcuate segment of said second shell to create a substantially closed cavity between opposing planar portions of said first and second shells.

The method of forming a slat or a rolling door in accordance with the invention comprises the steps of forming two identical shells, each shell comprising a planar portion defining a plane and longitudinal and transverse directions within said plane and having opposing first and second surfaces facing in opposing first and second normal directions and having parallel first and second longitudinal edges extending along said longitudinal direction of said planar portion, said elongate shell being formed along said first longitudinal edge with a first arcuate segment open in a direction of said first normal direction and formed along an opposing second longitudinal edge with a second arcuate segment also open in a direction of said first normal direction, said first and second arcuate segments being positioned on the same side of said planar portion and offset from said second surface in said second normal direction and configured and dimensioned to enable said second arcuate segment of a first shell to be received with clearance within a first arcuate segment of a second shell identical to said first shell to form an articulated hinge, whereby two hingedly joined elongate shells can be pivoted relative to each other from a generally co-planar orientation of planar portions of associated coupled or linked shells within said plane in directions to either side of said co-planar orientation; displacing said first and second shells by 180° within planes parallel to said planes of respective planar portions and being joined to each other by linking a first arcuate segment of said first shell with a second arcuate segment of said second shell and a second arcuate segment of said first shell with a first arcuate segment of said second shell to create a substantially closed cavity between opposing planar portions of said first and second shells.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENT

Figure 1:
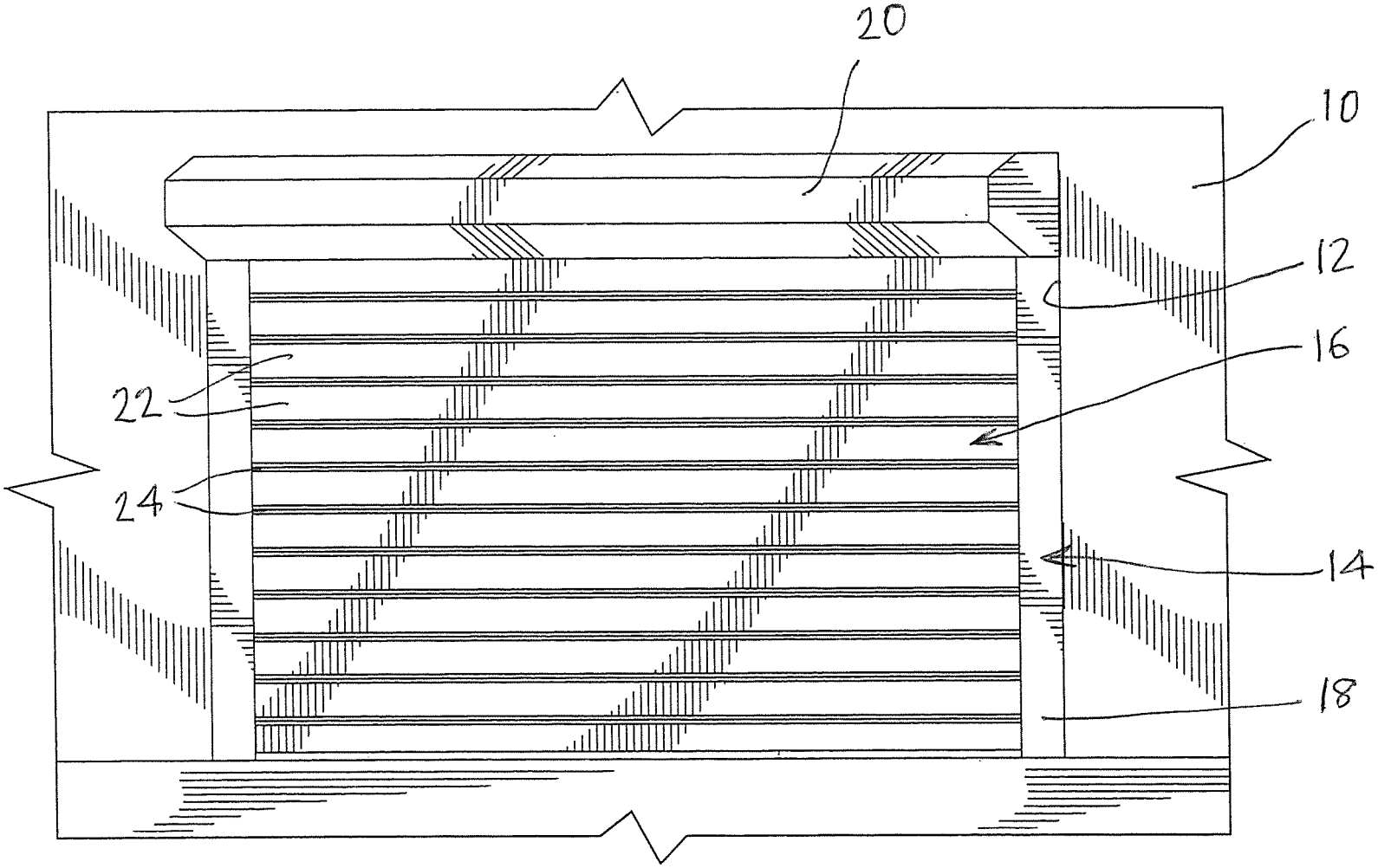
FIG. 1 is a front elevational view of a rolling door in its fully extended position to close an opening in an enclosure.

Referring now specifically to the figures, in which the identical or similar parts have been designated by the same reference numerals throughout, and first referring to FIG. 1, a structure 10, such as a garage of a building, includes an opening 12 to be selectively accessed by means of a curtain assembly 14 in the form of a rolling door 16 slidably mounted to be vertically raised or lowered by having the lateral edges of the curtain assembly slide within vertical tracks of a frame 18. The top of the rolling door 16 is received within a casing or housing 20 typically containing a horizontal shaft secured to the top of the curtain assembly 14 and operated by a motor for rolling the door into the housing casing 20 when the rolling door 16 is raised to provide access to the opening 12 or lowered from the casing or housing 20 when the rolling door is lowered to the position shown in FIG. 1 to close to prevent access to the structure 10. FIG. 1, therefore, illustrates a common or typical rolling door arrangement, utilizing a plurality of hingedly interconnected slats 22 that are interlocked at their upper and lower edges to provide articulated joints 24 between the slats. However, the constructions of prior art slats have varied considerably. Slats have typically been formed of multiple components and, in some cases, have required complex assembly procedures.

The slats in accordance with the present invention are formed of a unitary or singularly profiled extruded shell that can be used to assemble single and double-walled door slats that are either non-insulated or insulated and can be easily and inexpensively assembled to form single or double walled curtain assemblies.

An important feature of the invention is that all of the embodiments in accordance with the invention can be assembled or formed by using a single or unitary extrusion having a configuration or profile as shown in FIGS. 2-6. Thus, all the slats 22 of the curtain assembly 14 can be formed with a single extruded part having the profile shown and described. The extruded profile can be continuous and cut to size to produce shells or skins of the same desired lengths to provide two identical associated or complementary shells 26, 26' that are assembled by flipping, for each slat, one of the shells 26' 180° both about the axis B as well as the axis C (FIG. 2) to orient the otherwise identical associated shells to form a single slat as suggested in FIGS. 2-6. For purposes of the description that follows the shell 26 will sometimes also be referred to as an exterior, front or outside shell while the shell 26' will sometimes be referred to as an interior, rear or inside shell.

Figure 2:
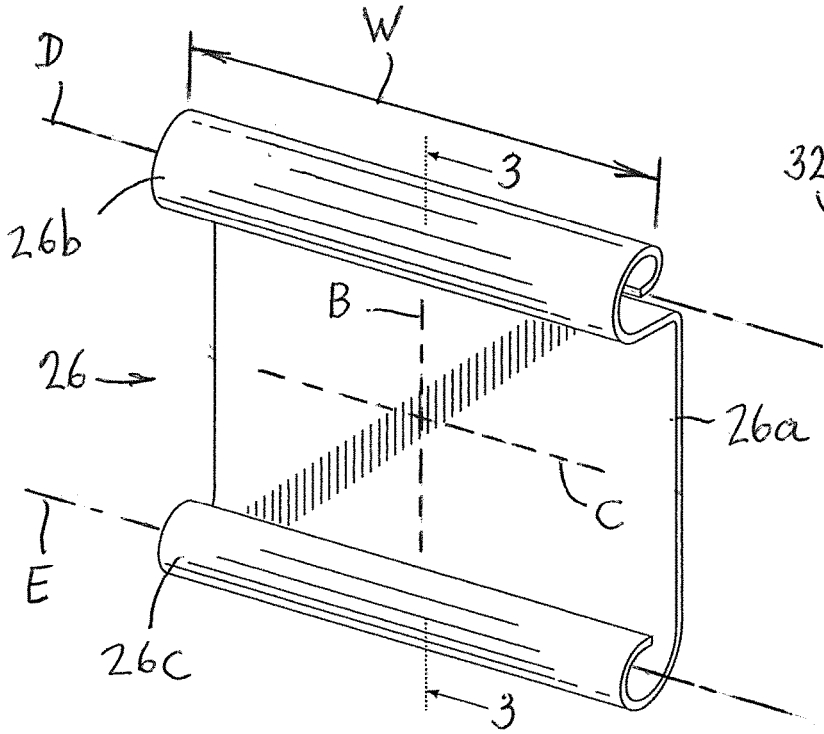
FIG. 2 is a perspective view of one side of a shell or skin for a rolling door slat prior to assembly.
Figure 3:
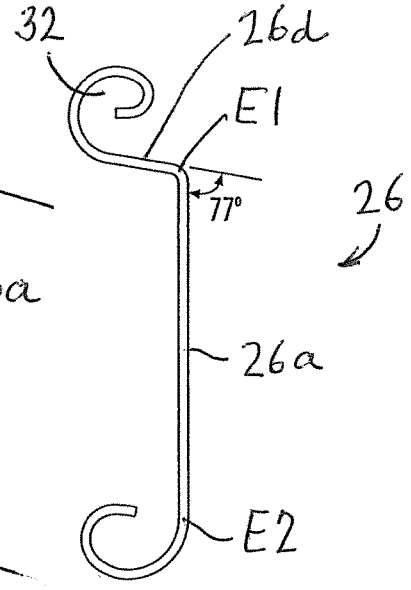
FIG. 3 is a cross-sectional view of the shell shown in FIG. 2 taken along line 3-3.
Figure 5:
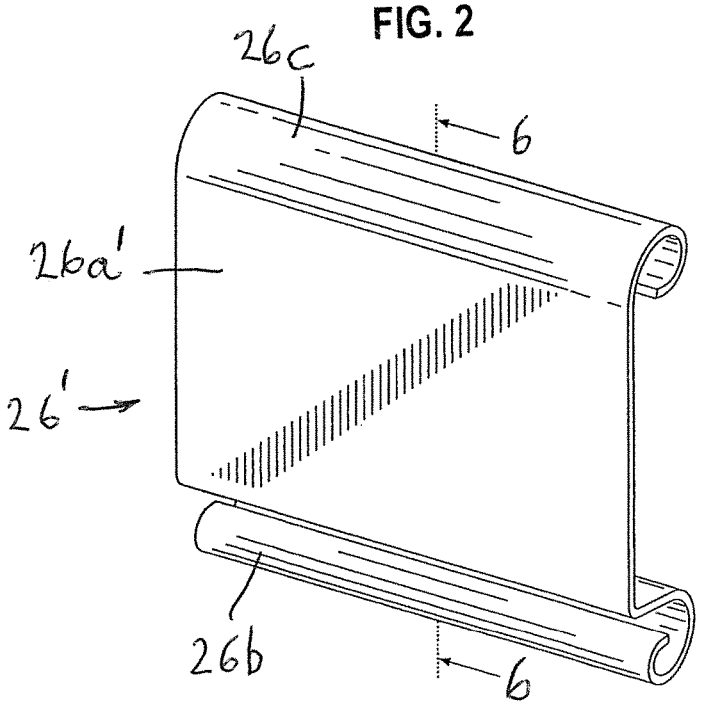
FIG. 5 is a perspective view of the other side of an associated or complementary shell identical to the one shown in FIG. 2 after being flipped 180° about both mutually orthogonal axes B and C shown in FIG. 2 from the initial orientation shown in FIGS. 2 and 3.
Figure 6:
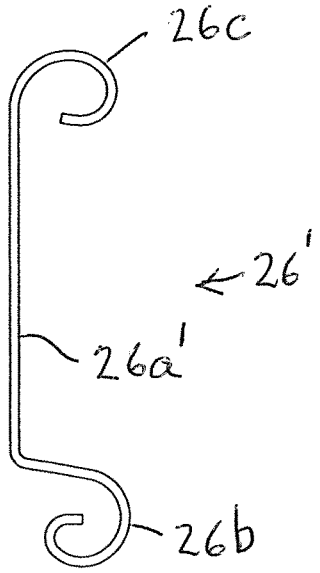
FIG. 6 is a cross-sectional view of the complementary shell shown in FIG. 5, taken along line 6-6.

Referring to FIGS. 2-3, each shell 26 includes a flat planar portion 26*a* having the desired width W. At the upper and lower longitudinal edges E1, E2 of the shell 26 there are provided, in cross-sections top or upper and bottom or lower arcuate segments or portions 26*b*, 26*c*, respectively. The arcuate segment 26*b* defines an axis D and is spaced rearwardly of the planar portion 26*a* as shown. The arcuate portion 26*c* defines a parallel axis E and is also spaced rearwardly of the planar portion 26*a* and positioned generally below the arcuate portion 26*b* as viewed in the Figures. Referring specifically to FIG. 3 the first arcuate segment or portion 26*b* has a configuration that, in cross section, emulates a lower case letter "e" integrally joined at the upper edge E1 to the flat portion 26*a* by means of an inclined flat transition portion 26*d*.

Along the lower edge E2 of the shell or skin 26 the second arcuate segment or portion 26*c* has a configuration that emulates a lower case letter "c." Both arcuate portions 26*b* and 26*c* are generally in the shape of spirals. The spirals can, for example, be in the shape of an Archimedean spiral that extends approximately four quadrants or 360° for the arcuate portion 26*b* and approximately three quadrants or 270° for the arcuate portion 26*c*. Other known spirals can be used as long as these result in a freely rotatable hinge when the arcuate portions 26*b*, 26*c* are interlocked as shown in FIGS. 8-15.

Figure 4:
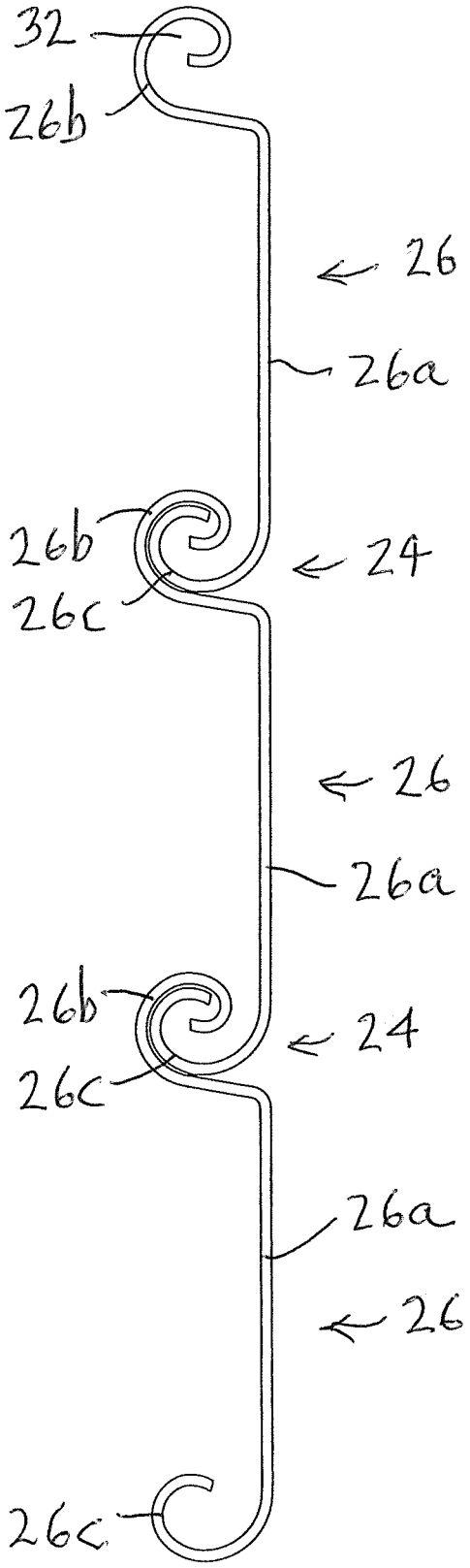
FIG. 4 is a side elevational view of three shells shown in FIGS. 2 and 3 pivotedly or hingedly connected to each other at their upper and lower arcuate portions to form a single shell walled door.

Referring to FIG. 4, the arcuate portions 26*b* and 26*c* are configured so that an arcuate portion 26*b* can receive an arcuate portion 26*c* with some clearance but in interlocking relation to form a hinged or articulated joint 24 as shown in FIG. 4 where three shells 26 are shown interlinked to form a simple single-walled non-insulated curtain assembly.

Figure 7:
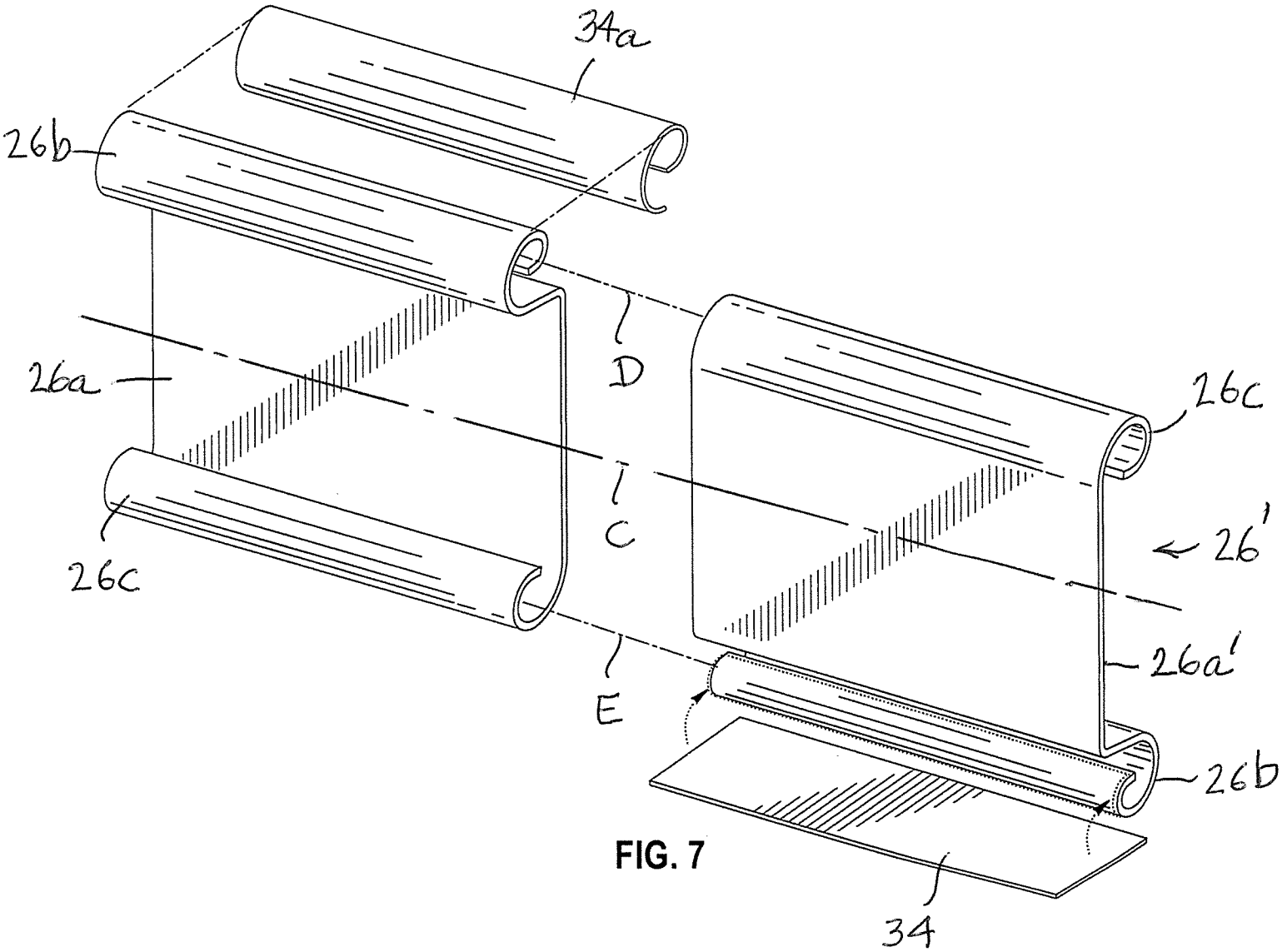
FIG. 7 is a perspective exploded view of the shells shown in FIGS. 2 and 5 prior to assembly to form a slat for a rolling door, and also showing an insulating tape or extruded insulating sheet or layer to be applied to the top arcuate portion of the shell shown in FIG. 2 as viewed in FIG. 7 prior to assembly and interlocking engagement between the two mating shells.
Figure 9:
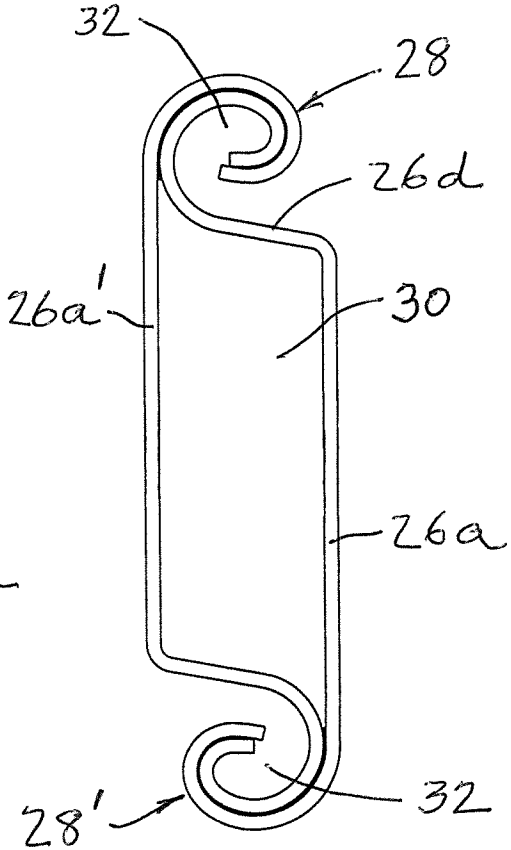
FIG. 9 is a side elevational view of an insulated slat similar to the one shown in FIG. 8.
Figure 8:
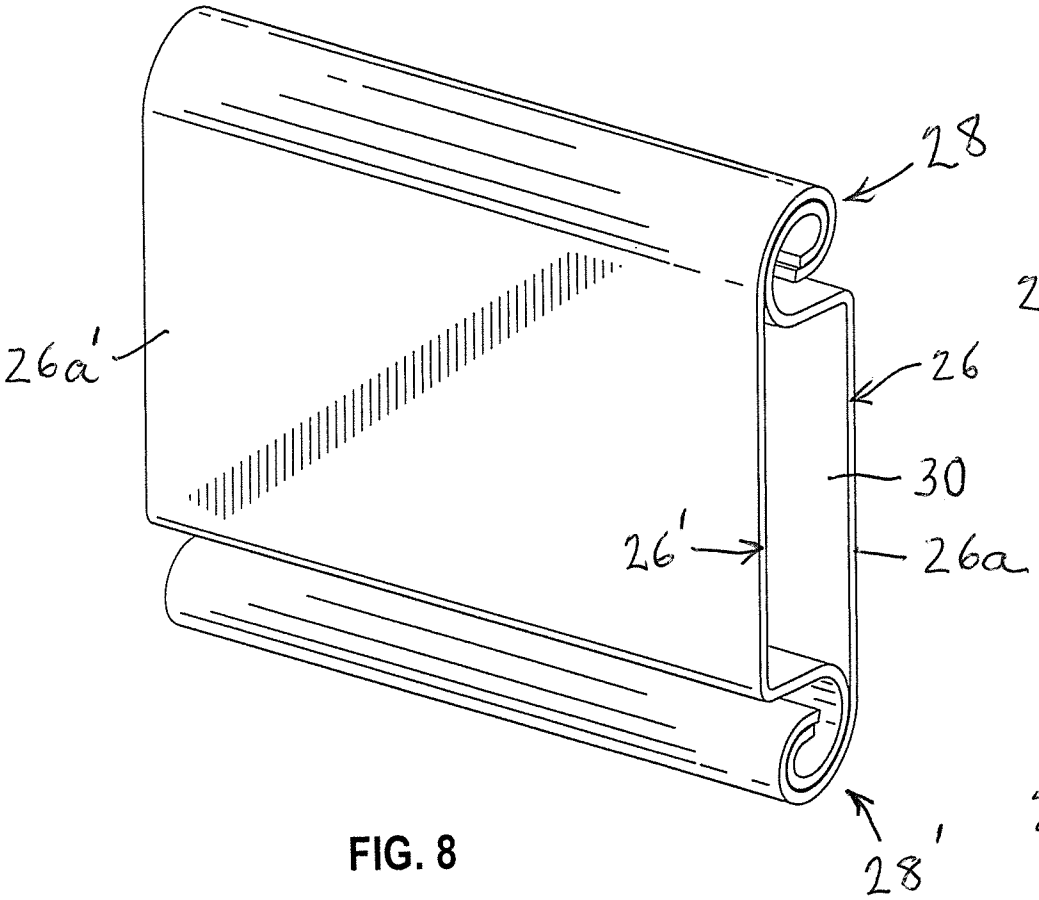
FIG. 8 is a perspective view of the two shells shown in FIGS. 2-7 after these have been slidably assembled together to form a slat, also showing the insulating tape between the outer and inner surfaces of the arcuate segments or portions.

Referring to FIG. 7, after the second or associated shell, cover or skin 26' has been suitably oriented, as shown, the two associated shells 26, 26' are aligned generally along the longitudinal axis C so that the axis D of the upper arcuate segment 26*b* of the shell 26 is coextensively aligned with the axis E of the upper arcuate segment 26*c* of the shell 26' and the lower arcuate segments are similarly aligned. Now, these shells can be slidably engaged to lock the upper first and second arcuate segments 26*b*, 26*c*, at the top, and the lower arcuate segments 26*b* and 26*c* at the bottom of the shells to the final positions shown at FIG. 8 to create oppositely directed claws or hooks 28, 28'. Once the front and rear shells 26, 26', respectively, are interlocked they remain interlocked and cannot separate except by reversing the steps and sliding the shells apart along the axis C to the positions shown in FIG. 7.

It will be clear that interlocking the front and rear shells 26, 26' as described creates a double-walled slat 22 and a generally longitudinal space or cavity 30 between the planar portions 26*a*, 26*a'* as well as a longitudinal channel 32 at the top (as viewed in FIG. 8) dimensioned to slidably receive a claw or hook 28, 28' of an associated slat to which it is to be pivotably or hingedly connected.

One feature of the invention is the application of insulating tape 34 between the outer surface of a first arcuate portion 26*b* of the shell 26 and the inner surface of a second arcuate portion 26*c* of shell 26' along the surfaces that would normally be in contact with each other. Normally it should be simpler and/or more convenient to apply the tape 34 to the outer surface of the arcuate portion 26*b* instead of applying it to the inner surface of the arcuate portion 26*c*, it is not critical as to where the insulating tape is initially applied as long as it is placed between the surfaces that would normally be in contact with each other to provide a thermal break or temperature barrier between the two juxtaposed arcuate portions.

The insulation 34 may also be in the form of an extruded plastic sheet 34*a* dimensioned to conform and fit between the two arcuate portions 26*b*, 26*c*.

Figure 10:
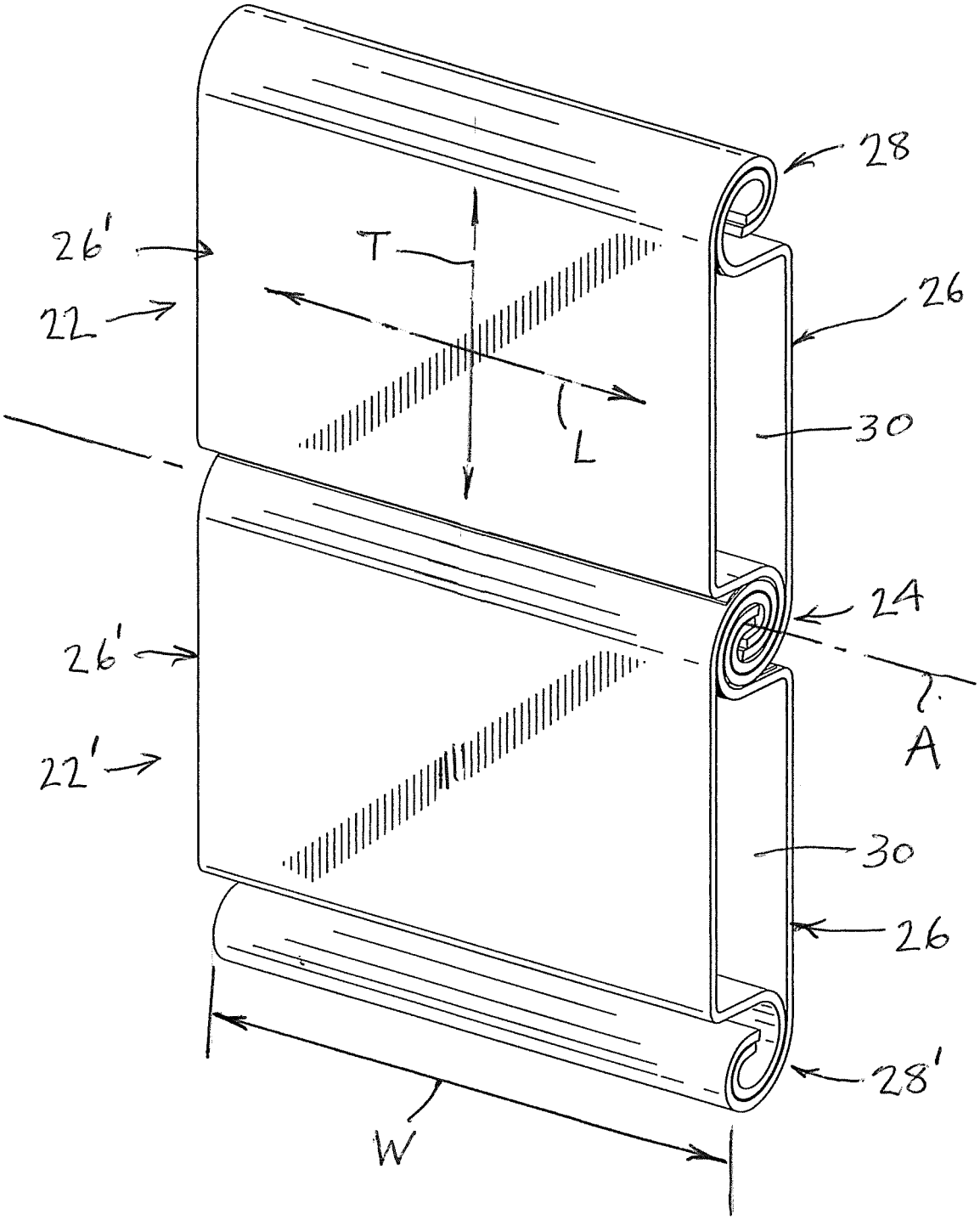
FIG. 10 is a perspective view of two interlocked hingedly or pivotally connected slats in accordance with the present invention when both slats are generally arranged in a common plane.
Figure 11:
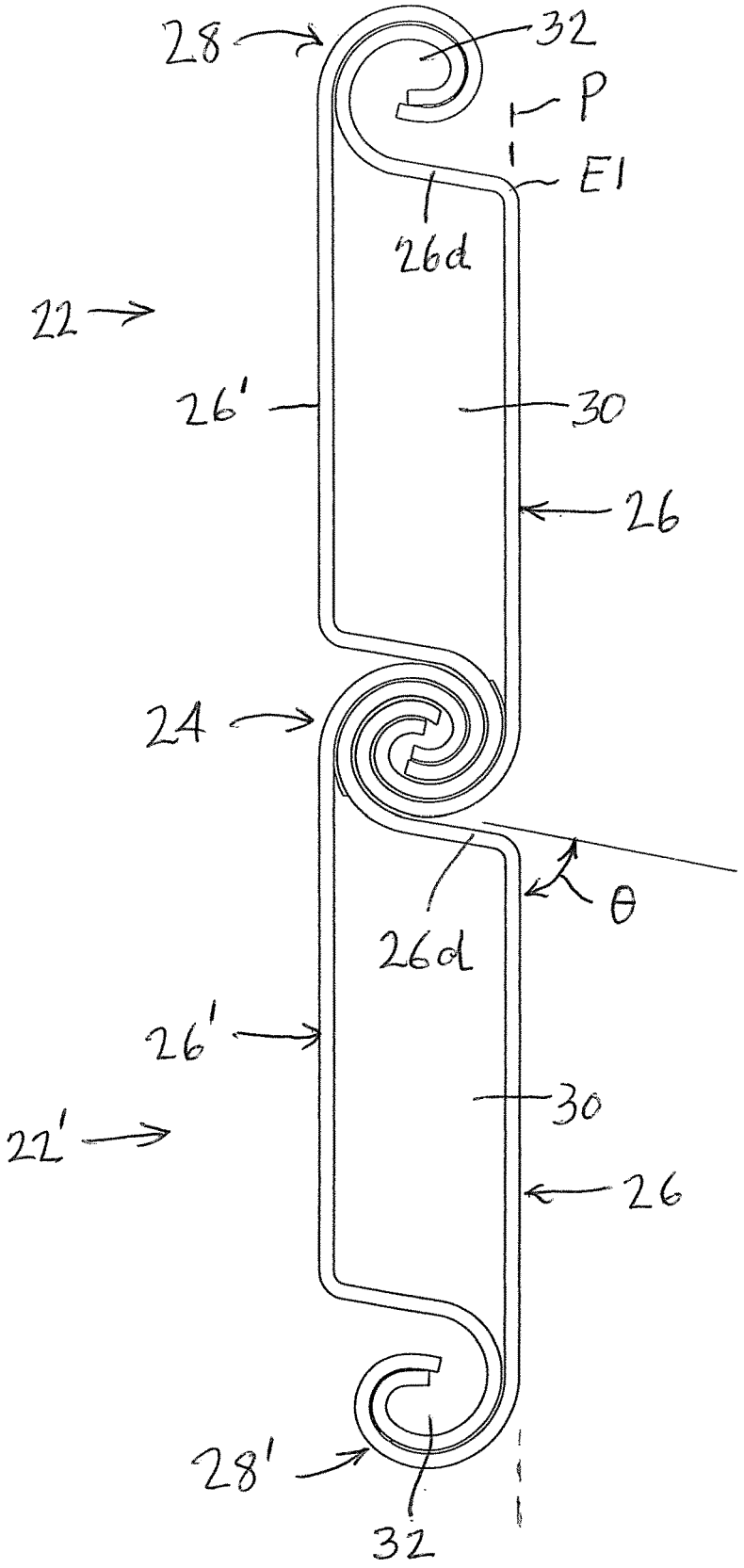
FIG. 11 is similar to FIG. 10, but shows the two slats in a common plane prior to pivoting or rotational movements, and also shows the insulated slats without additional insulation between the opposing shell surfaces of the contacting arcuate portions.

Referring to FIGS. 10 and 11, two dual-walled slats are shown joined in interlocking relationship to each other at an articulated joint or hinge 24. Each slat assembly is formed of a plurality of associated or cooperating shells 26, 26'. For the purposes of the description, the upper slat or panel, as viewed in FIG. 10, is designated by the reference numeral 22 while the lower slat is designated by the reference numeral 22'. The slats are interlocked for rotating or pivoting movements relative to each other about the articulated joints or hinges 24. The slat 22 has a longitunal direction L along the width of the slat and a height component H along a transverse direction T. Each articulated joint or hinge 24 defines an axis A about which the slats 22, 22' can rotate relative to each other to move from being in a common plane when the slats 22, 22' are similarly oriented as shown in FIG. 10 to pivot or rotate relative to each other to assume orientations in different planes as shown or suggested in FIG. 13 to allow the curtain assembly 14 to be rolled up. Each of the slats 22, 22' in FIG. 10 are non-insulated.

It is also an important feature of the invention that the slats, whether single walled or double walled, incorporate identical profiled shells or skins 26, 26' that can be extruded as a continuous length profile. By suitably cutting the extruded profile into desired length pieces and orienting the shells relative to one another as described they can be formed into double walled slats or panel assemblies without the use of connectors or fasteners. FIGS. 8-15 show slats that are double walled to provide inner spaces or cavities 30 between the shell or skin planar portions 26*a*, 26*a'*.

Referring to FIGS. 2-7, a single elongate shell 26 can be used to form single or double walled articulated curtains that are insulated or non-insulated depending on how it is used and interconnected with other like shells. Being that all of the slats have the same profile they can be formed by cutting equal length sections from a unitary extrusion as aforementioned.

Referring to FIGS. 8-11 a longitudinal channel 32 is formed when two shells 26, 26' are assembled as described. The dimensions and shape of the longitudinal channel 32 is selected to receive first and second arcuate segments 26*b*, 26*b'* forming a claw or hook 28, 28' of an adjoining slat to form an articulated joint or hinge 24 that allows adjacent slats to rotate about the hinge or joint into different planes from the plane P (FIG. 3) where the slats are aligned.

Figure 14:
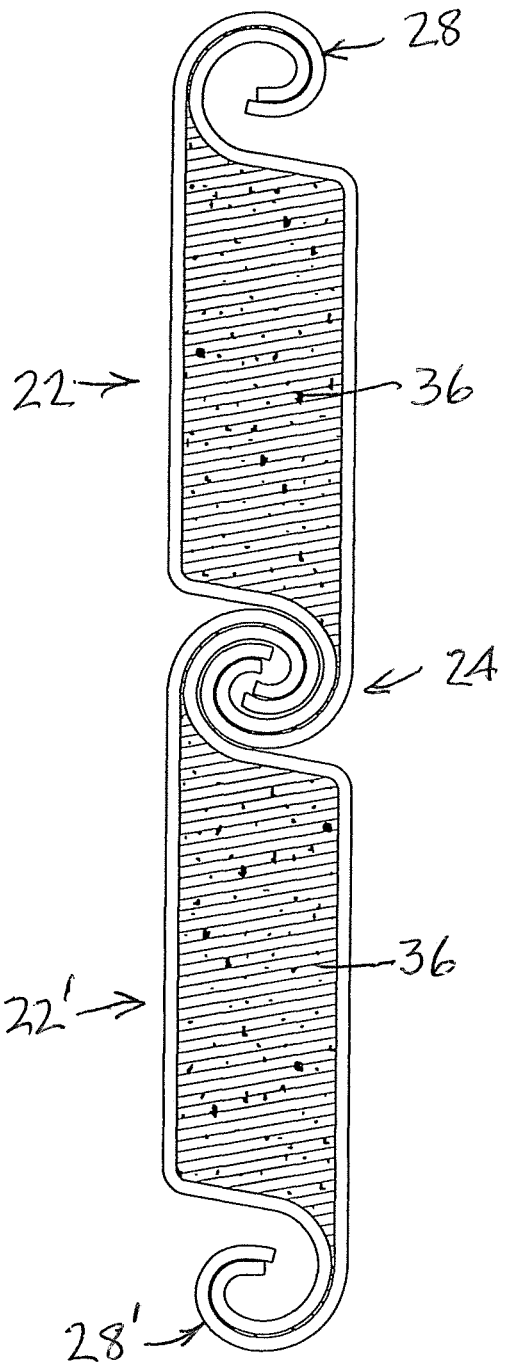
FIG. 14 is similar to FIG. 12 but also shows foam insulation filling the cavity between the planar surfaces of each two associated or cooperating shells.
Figure 15:
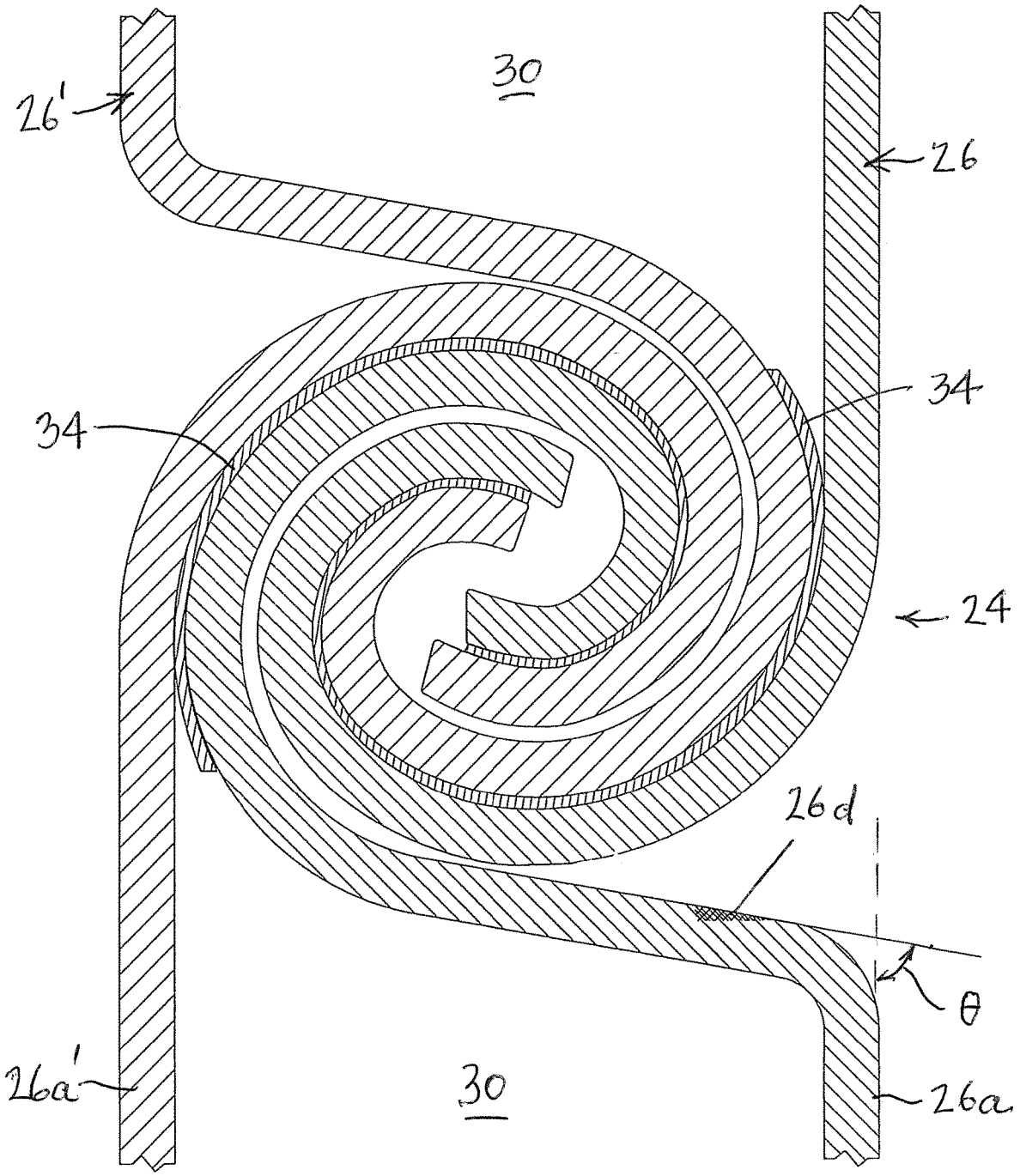
FIG. 15 is an enlarged section of the joint formed by the two slats shown in FIGS. 10 and 11.

Referring to FIGS. 11 and 15, the angle θ formed between the planar portion 26*a* and the flat transition portion 26*d* and the planes of the planar connecting portions is less than 90°. In a presently preferred embodiment, the angle θ is selected to be within the range of 70–85° and in the embodiment shown, the angle θ is equal to approximately 77°. Referring to FIGS. 11-15, it will be evident that orienting the flat transition portions 26*d* as shown and described insures that water from rain that impinges on the exterior, front or outside shells 26 drains away from the joints or hinges 24 and down the door 16 thereby keeping rain water away from the interior shells 26' and out of the structure 10.

Figure 13:
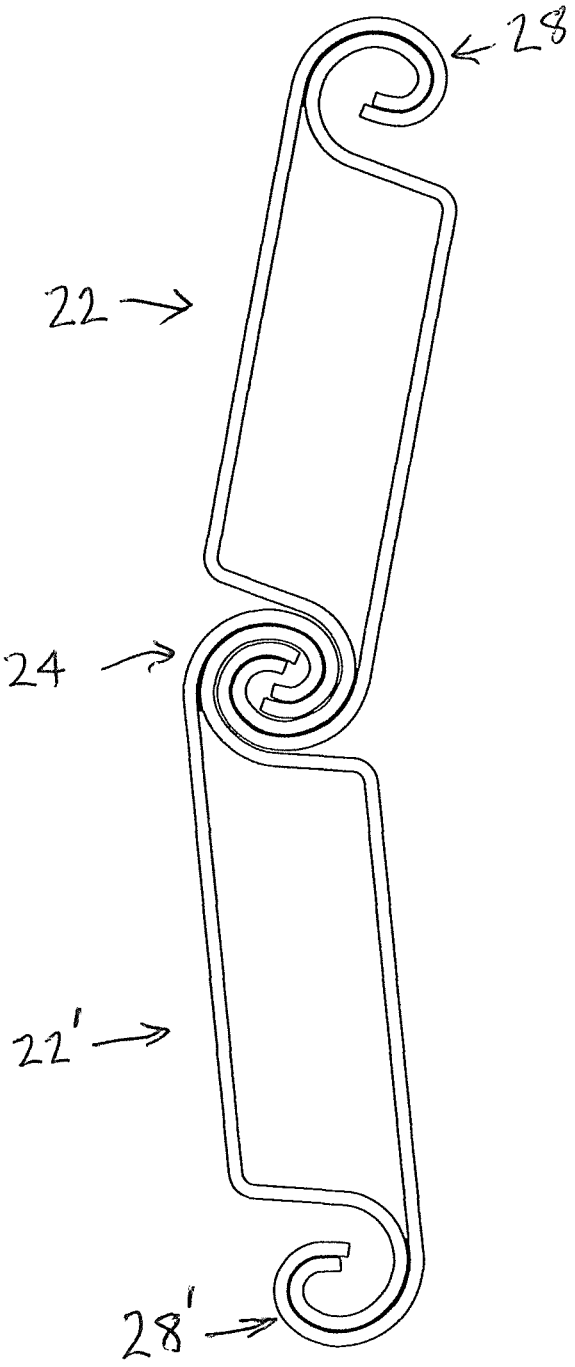
FIG. 13 is similar to FIG. 12 but shows the two insulated slats pivoted or rotated about a joint or hinge to place the slats in different planes.

In FIG. 13 the two articulated slats are shown rotated or pivoted relative to each other into different planes as is necessary to roll up the door into a generally cylindrical configuration when access is to be provided to the structure through the opening 12. An enlarged view of the hinge or articulated joint 24 is shown in FIG. 15 in which two pairs of arcuate segments or portions forming two interconnected claws or hooks 28, 28' are interlocked to prevent movements along the direction B (FIG. 2) but that allow relative pivoting or movement of the slats about the axis A (FIG. 10). Once the two adjacent slats are connected to each other, by sliding movements of the slats along the direction C (FIGS. 2 and 7) they cannot be separated but can only rotate or pivot about the articulated joint or hinge 24.

It will be clear that if the exterior, outside or front shell 26 is exposed to the elements, the insulation 34 will prevent heat transfer from the interior or inside shell 26' from flowing to the exterior or outside shell 26 through the arcuate segments or portions 26*b*, 26*c* forming the claws 28, 28'.

Figure 12:
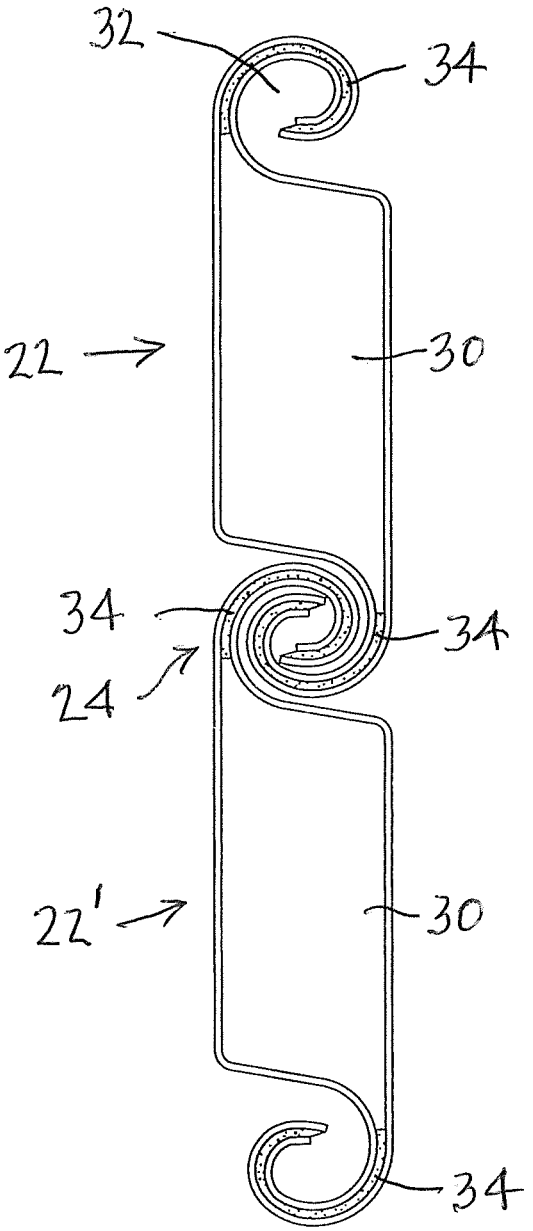
FIG. 12 is similar to FIG. 11 but shows insulation between the engaged arcuate portions.

Referring to FIG. 14, the internal space or cavity 30 can be filled with air, as shown in FIGS. 10-12, that also serves as an insulator to prevent heat transfer from the inside or interior shell 26' to the outer or exterior shell 26. If desired, however, the inner space or cavity 30 can also be filled with foam insulation 36 to provide additional insulation between the flat panel portions 26*a*, 26*a'*, since escape of heat through the interlocked hinged portions is already prevented by the use of insulation tape 34 or an extruded insulating sheet or layer 34*a*.

The material from which the shells are extruded is not critical. However, for these applications, the shells may be formed of iron or steel sheet metal having a thickness selected within the range of 10-13 gauge. However, the shells can also be formed of a synthetic compound or elastomeric plastic materials. The planar portions 26*a*, 26*a'* of the outside and inside shells 26, 26' are preferably spaced from each other a distance selected to be within the range 0.6"-1.5".

Figure 16:
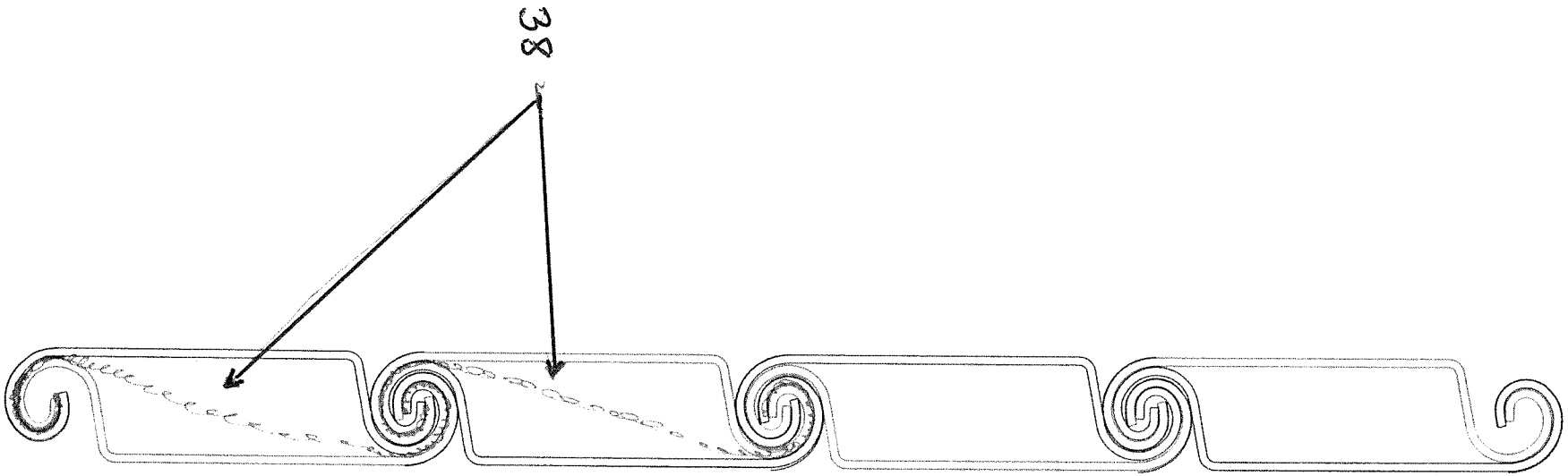
FIG. 16 is similar to FIG. 11, showing how the slats can be modified to enhance their resistance to ballistics.

When the shells and slats are formed of iron or steel sheets the resistance of the slats to ballistics will be a function of the thickness or gage of the sheets used. However, especially when the weight of the rolling doors formed from the slats is a factor and is to be reduced or minimized, the described construction can be easily modified to enhance the resistance of the panels or slats to ballistics without materially increasing the weight. Referring to FIG. 16, at least one of the shells 26, 26' can be formed of a sheet of anti-ballistic plastic. It is also possible to laminate one or both surfaces of the shells with ballistic resistant materials. Also shown in FIG. 16 are interior sheets of ballistic resistant materials 38 that are supported at upper and lower edges by the associated claws or hooks at the articulated joints 24 as shown. By adding these sheets 38 the entire vertical heights are reinforced against ballistics piercing the slats. The specific anti-ballistic materials used are not critical as long as they can easily be applied as shown and may be rigid or flexible. Suitable plastics that can be used for this purpose include, but are not limited to, Kevlar®, Lexan®, Acrylic (PMMA) glass such as Crylux™, Plexiglas®, Acrylite®, Lucite®, and Perspex®; Polycarbonate and carbon fiber composite materials. Conforming sheets of suitable thickness steel can also be used in lieu of the plastic inserts 38, such as ⅛" or ¼" steel.

The method of forming a slat for a rolling door in accordance with the invention is, therefore, to cut suitably dimensioned lengths of an extruded profile having a cross-section as shown and described, and forming two identical shells 26, 26' with each shell comprising a planar portion 26*a*, 26*a'* defining a plane and having parallel first and second longitudinal edges E1, E2 extending longitudinal direction of the planar portion. The elongate shell is formed along the first longitudinal edge with a first or upper arcuate segment or portion 26*b* and formed along an opposing second longitudinal edge E2 with a second arcuate segment or portion 26*c*. The first and second arcuate segments or portions 26*b*, 26*c* are positioned on the same side of the planar portion 26*a* of a respective shell and configured and dimensioned to enable the second arcuate segment of a first shell to be received with clearance within a first arcuate segment of a second shell identical to the first shell to form an articulated hinge. In this manner, two hingedly joined elongate shells can be pivoted relative to each other from a generally co-planar orientation of planar portions of associated coupled or linked shells. The exterior, outside or front and the interior, inside or rear shells are displaced by 180° about mutually orthogonal directions within a planar portion and are joined to each other by linking a first arcuate segment of the exterior shell with a second arcuate segment of an interior shell and a second arcuate segment of the first shell with a first arcuate segment of the interior shell after these have been aligned along associated axes to create a substantially closed cavity between opposing planar portions 26*a*, 26*a'*. As indicated, the two shells are formed by cutting sections or pieces from a single extrusion and therefore have the identical profiles described above. Advantageously, a thermal insulation layer is then applied between each linked pair of first and second arcuate segments so that these do not contact each other at the facing inner or outer surfaces, respectively.

It will be clear, therefore, that a single profiled extrusion can be easily and inexpensively formed into slats from a minimum number of parts into a curtain assembly for a rolling door that is both thermally insulated whether or not the interior space or cavity within each of the slats is filled with additional insulation, such as foam insulation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A rolling door slat comprising first and second substantially identical elongate shells, each shell comprising a planar portion defining a plane and longitudinal and transverse directions within said plane and having opposing first and second surfaces facing in opposing first and second directions normal to said plane and having parallel first and second longitudinal edges extending along said longitudinal direction of said planar portion, each elongate shell being formed along said first longitudinal edge with a first arcuate segment open in a direction of said first normal direction and having a free first distal edge and formed along said second longitudinal edge with a second arcuate segment also open in a direction of said first normal direction and having a free second distal edge, said first and second arcuate segments of each shell being positioned on a same side of said planar portion and offset from said planar portion in said second normal direction and configured and dimensioned to enable said second arcuate segment of said first shell to be received within said first arcuate segment of said second shell when said first and second shells are angularly offset or displaced 180° from each other in planes parallel to said planar portions of said first and second shells and interlocked to form an interior space or cavity defined by said second surfaces of said first and second shells that form spaced opposing interior surfaces of the assembled slat; and a pre-formed thermally insulating sheet of plastic having a substantially uniform thickness conforming to the shape of and receivable only between said opposing interior surfaces that extend into said arcuate segments to physically separate said first and second arcuate segments to provide thermal insulation between said first and second shells to form a thermal break between said first and second shells.

2. The rolling door slat as defined in claim 1, wherein said first arcuate segment is generally in the shape of a spiral extending approximately 360° and is e-shaped.

3. The rolling door slat as defined in claim 1, wherein said second arcuate segment is generally in the shape of a spiral extending an angle less than 360° and is c-shaped.

4. The slat as defined in claim 1, wherein said arcuate segments of each shell have substantially uniform cross-sections along said longitudinal direction by transverse cutting planes normal to said planar portion.

5. The slat as defined in claim 4, wherein each first arcuate segment is generally in the shape of a spiral extending approximately 360° and is e-shaped.

6. The slat as defined in claim 1, wherein said planar portions of said first and second shells are spaced from each other a distance selected from the range of 0.6"-1.5".

7. The slat as defined in claim 1, wherein each pair of linked first and second arcuate segments of a rolling door slat forms a longitudinal receiving opening dimensioned to receive a pair of linked first and second arcuate segments of substantially identical slats.

8. The slat as defined in claim 1, wherein said thermally insulating sheet comprises a layer of thermally insulating tape.

9. The slat as defined in claim 1, wherein said cavity is filled with thermally insulating material.

10. The slat as defined in claim 9, wherein said insulating material is an insulating foam.

11. The slat as defined in claim 1, further comprising a layer of ballistic resistant material extending a height of the slat substantially between opposing articulated hinges.

12. The slat as defined in claim 11, wherein said material is a plastic material.

13. The slat as defined in claim 12, wherein said plastic material is selected from the group consisting of Acrylic (PMMA) glass, polycarbonate and carbon fiber composite materials, synthetic resin and acrylic panel or sheet materials.

14. The slat as defined in claim 11, wherein said material is a sheet of metallic material.

15. The slat as defined in claim 14, wherein said metallic material is a steel sheet.

16. A method of forming a longitudinal slat for a rolling door comprising the steps of forming first and second substantially identical elongate shells, each shell comprising a planar portion defining a plane and longitudinal and transverse directions within said plane and having opposing first and second surfaces facing in opposing first and second directions normal to said plane and having parallel first and second longitudinal edges extending along said longitudinal direction of said planar portion, each elongate shell being formed along said first longitudinal edge with a first arcuate segment open in a direction of said first normal direction and formed along said second longitudinal edge with a second arcuate segment also open in a direction of said first normal direction, said first and second arcuate segments of each shell being positioned on a same side of said planar portion and offset from said planar portion in said second normal direction and configured and dimensioned to enable the second arcuate segment of said first shell to be received within said first arcuate segment of said second shell when said shells are angularly offset or displaced 180° from each other in planes parallel to said planar portions of said first and second shells to form an interior space or cavity defined by said second surfaces of said first and second shells to form substantially coextensive distal edges of said first and second arcuate segments; and initially applying a thermally insulating tape of substantially uniform thickness to only one of said opposing interior surfaces such that the thermally insulating tape is retained by the respective interior surface prior to interlocking said first and second arcuate segments to physically separate said arcuate segments to provide a thermal break between the interlocked first and second arcuate segments, whereby said first and second shells form said longitudinal slat providing thermal insulation between said first and second shells.

17. The slat as defined in claim 1, wherein said thermally insulating sheet comprises an extruded thermally insulating member.

18. A rolling door slat comprising first and second substantially identical elongate shells, each shell comprising a planar portion defining a plane and longitudinal and transverse directions within said plane and having opposing first and second surfaces facing in opposing first and second directions normal to said plane and having parallel first and second longitudinal edges extending along said longitudinal direction of said planar portion, each elongate shell being formed along said first longitudinal edge with a first arcuate segment open in a direction of said first normal direction and having a free first distal edge and formed along said second longitudinal edge with a second arcuate segment also open in a direction of said first normal direction and having a free second distal edge, said first and second arcuate segments of each shell being configured and dimensioned to enable said second arcuate segment of said first shell to be received within said first arcuate segment of a second shell when said first and second shells are angularly offset or displaced 180° from each other in planes parallel to said planar portion to form substantially coextensive distal edges of said first and second arcuate segments when interlocked; and a thermally insulating tape of substantially uniform thickness initially applied to one of said opposing interior surfaces prior to interlocking said arcuate segments to physically separate and provide a thermal break between the interlocked arcuate segments of said first and second shells, whereby said first and second shells when interlocked form a longitudinal slat in which said first and second shells are thermally insulated from each other, wherein the insulating tape is substantially coextensive with the coextensive distal edges of the arcuate segments.

19. The method of claim 16, wherein said first and second shells are cut from a single or identical extrusion.

* * * * *